US007282015B1

(12) United States Patent
White

(10) Patent No.: US 7,282,015 B1
(45) Date of Patent: Oct. 16, 2007

(54) RESISTANCE TRAINING EXERCISE

(75) Inventor: Eric C. White, Streamwood, IL (US)

(73) Assignee: Brunswick Corporation, Lake Forest, IL (US)

( * ) Notice: Subject to any disclaimer, the term of this patent is extended or adjusted under 35 U.S.C. 154(b) by 323 days.

(21) Appl. No.: 10/967,617

(22) Filed: Oct. 18, 2004

(51) Int. Cl.
*A63B 21/06* (2006.01)

(52) U.S. Cl. ..... 482/94; 482/95

(58) Field of Classification Search ..... 482/94, 482/98, 99, 115, 118, 120, 62, 121–122, 131, 482/133, 135–136, 139, 148; D21/662, 665, D21/673, 667; D8/360
See application file for complete search history.

(56) References Cited

U.S. PATENT DOCUMENTS

| | | | | |
|---|---|---|---|---|
| 5,102,121 | A * | 4/1992 | Solow et al. | 482/94 |
| 5,624,353 | A * | 4/1997 | Naidus | 482/5 |
| 5,885,193 | A * | 3/1999 | Habing et al. | 482/92 |
| 6,719,672 | B1 * | 4/2004 | Ellis et al. | 482/99 |
| 6,958,032 | B1 * | 10/2005 | Smith et al. | 482/121 |
| 2003/0092540 | A1 * | 5/2003 | Gillen | 482/99 |

* cited by examiner

*Primary Examiner*—Lori Amerson
(74) *Attorney, Agent, or Firm*—Andrus, Sceales, Starke & Sawall, LLP

(57) ABSTRACT

Exercise apparatus for resistance training has a pulley with a user-adjustable camming profile for changing the load curve.

19 Claims, 4 Drawing Sheets

RESISTANCE TRAINING EXERCISE

BACKGROUND AND SUMMARY

The invention relates to exercise apparatus, and more particularly to resistance training apparatus.

Various types of exercise apparatus for resistance training are known in the prior art. In one type of apparatus, a cable is trained around a pulley having a camming profile providing a load curve in a plot of force versus displacement. Resistive force opposing user motion varies during such motion according to displacement, e.g. by use of an eccentric cam.

The present invention provides improvements, including a user-adjustable camming profile for changing the load curve.

DETAILED DESCRIPTION

Figure 1:
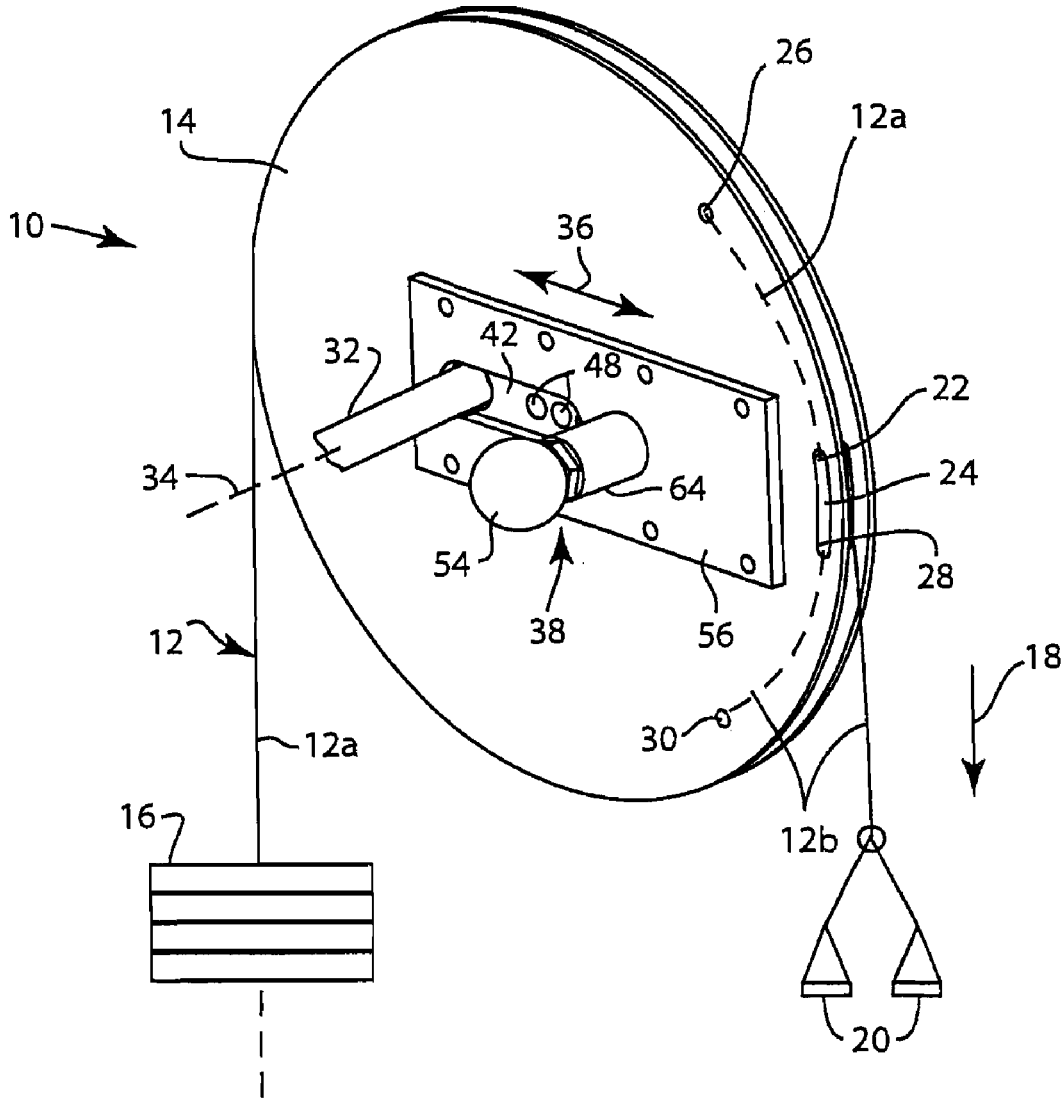
FIG. 1 is a schematic perspective view of exercise apparatus in accordance with the invention.

FIG. 1 shows exercise apparatus 10 for resistance training, including a cable 12, which may be of the rope type, belt type, or other type, trained around a pulley 14 and coupled to a resistance 16, such as a weight stack, resilient biasing spring, or other resistance mechanism, for resisting a given user motion as shown at arrow 18, for example by a user pulling handgrips 20. As is known, the pulley has a camming profile providing a load curve in a plot of force versus displacement, i.e. angular displacement of pulley 14 corresponding to translational displacement of handgrips 20 or other mechanism engaged by the user and resisting user motion. The cable may be provided by a single cable 12 preferably cogged or toothed to prevent slippage thereof around pulley 14. Alternatively, the cable may be provided by a first cable section 12*a* extending from weight stack 16 around the pulley and then laterally through upper end 22 of pulley slot 24 and then looped back as shown in dashed line at 12*a* and tied or anchored to the pulley, e.g. at bolt hole 26, and a second cable section 12*b* extending from handgrips 20 or the like and then laterally through lower end 28 of pulley slot 24 and then looped back as shown in dashed line at 12*b* and anchored or tied to the pulley, e.g. at bolt hole 30.

In the present invention, the pulley is provided with an adjustable camming profile for changing the noted load curve. Pulley 14 is eccentrically mounted on a shaft 32 for rotation about a rotation axis 34. The eccentricity provides the noted camming profile. Pulley 14 is translational across shaft 32 in a direction 36 transverse to axis 34 to change the noted eccentricity. A user-engageable locking mechanism 38 has a first locking position, to be described, locking pulley 14 in a given translational position, and has a second release position, to be described, permitting translational movement of pulley 14 in the noted transverse direction 36 to a different translational position to change the noted load curve.

Figure 2:
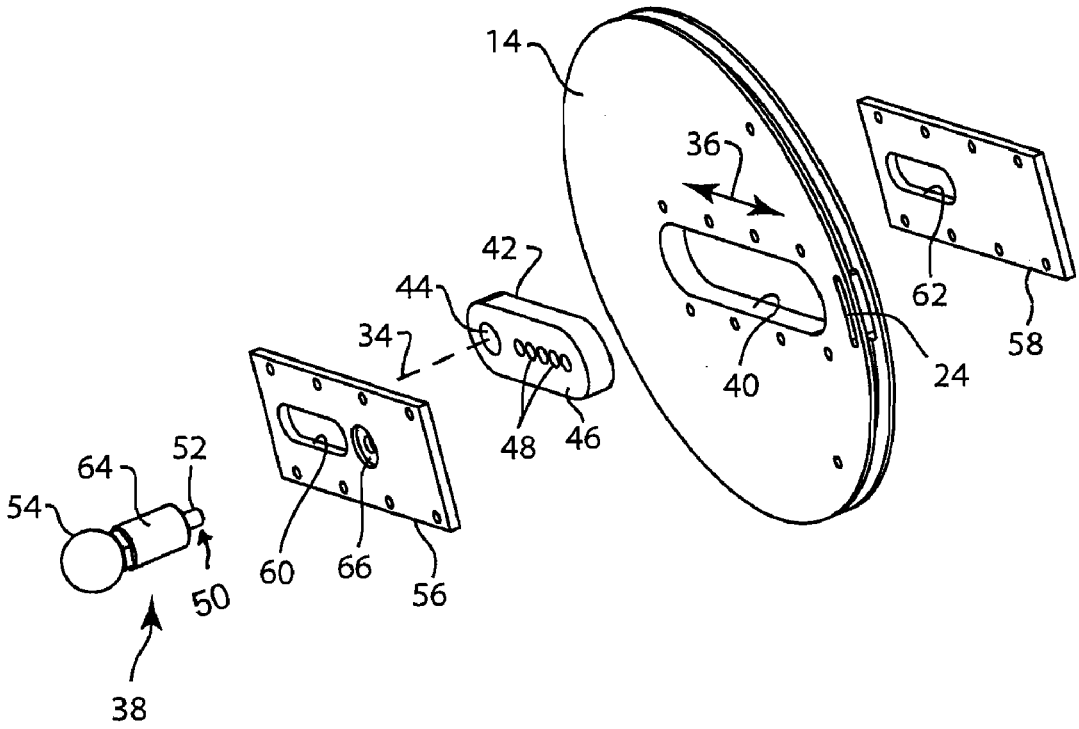
FIG. 2 is an exploded perspective view of a portion of FIG. 1.

Pulley 14 has a slot 40, FIG. 2, receiving shaft 32 extending axially therethrough. Pulley slot 40 has an extended dimension along the noted transverse direction 36 receiving shaft 32 at a plurality of translational positions therealong. The noted user-engageable locking mechanism includes a slide block 42 having a shaft-mount portion 44 provided by an aperture extending axially therethrough and mounted to shaft 32. Slide block 42 extends transversely from aperture 44 to a pulley-lock portion 46 having a plurality of smaller apertures or blind holes 48 therein. A user-engageable retainer member 50 cooperates between the pulley and the pulley-lock portion 46 of slide block 42 to provide the noted adjustment, to be described. In one embodiment, the noted retainer member is provided by a spring-loaded pin 52 having a normally rightwardly biased locking position in FIG. 2, and having a knob 54 on the leftward outer end thereof which may be pulled leftwardly by the user to a release position. The retainer member is moveable, rightwardly in FIG. 2, to the noted first locking position locking pulley 14 to slide block 42 to rotate therewith about shaft 32. The retainer member is moveable by the user to the noted second release position, leftwardly in FIG. 2, releasing pulley 14 from slide block 42 and permitting translational movement of pulley 14 along transverse direction 36 to a different translational position of pulley slot 40 along shaft 32 and of pulley 14 along slide block 42.

First and second axially spaced plates 56 and 58, FIG. 2, are mounted, e.g. by rivets, bolts, pins, welding, etc., to pulley 14 on axially distally opposite sides thereof at pulley slot 40. The plates have respective slots 60 and 62 receiving shaft 32 extending axially therethrough. Pulley slot 40 is axially between first plate slot 60 and second plate slot 62. First plate slot 60 and pulley slot 40 and second plate slot 62 are axially aligned. User-engageable retainer member 50 includes a sleeve 64 mounted to plate 56 at recess 66, e.g. by welding, adhesive bonding, etc. Locking pin 52 is moveable in a first axial direction, e.g. rightwardly in FIG. 2, toward second plate 58 to engage slide block 42 in the noted first locking position, namely by entry of pin 52 into a respective one of locking holes 48 of slide block 42. Locking pin 52 is moveable in a second opposite axial direction, e.g. leftwardly in FIG. 2, upon leftward pulling of knob 54 by the user, away from second plate 58 to disengage slide block 42 in the noted second release position, namely by disengagement and retraction of pin 52 from a respective hole 48 of slide block 42. Pulley 14 may then be moved to a different translational position along direction 36 to change the eccentricity of pulley 14 about shaft 32.

Figure 3:
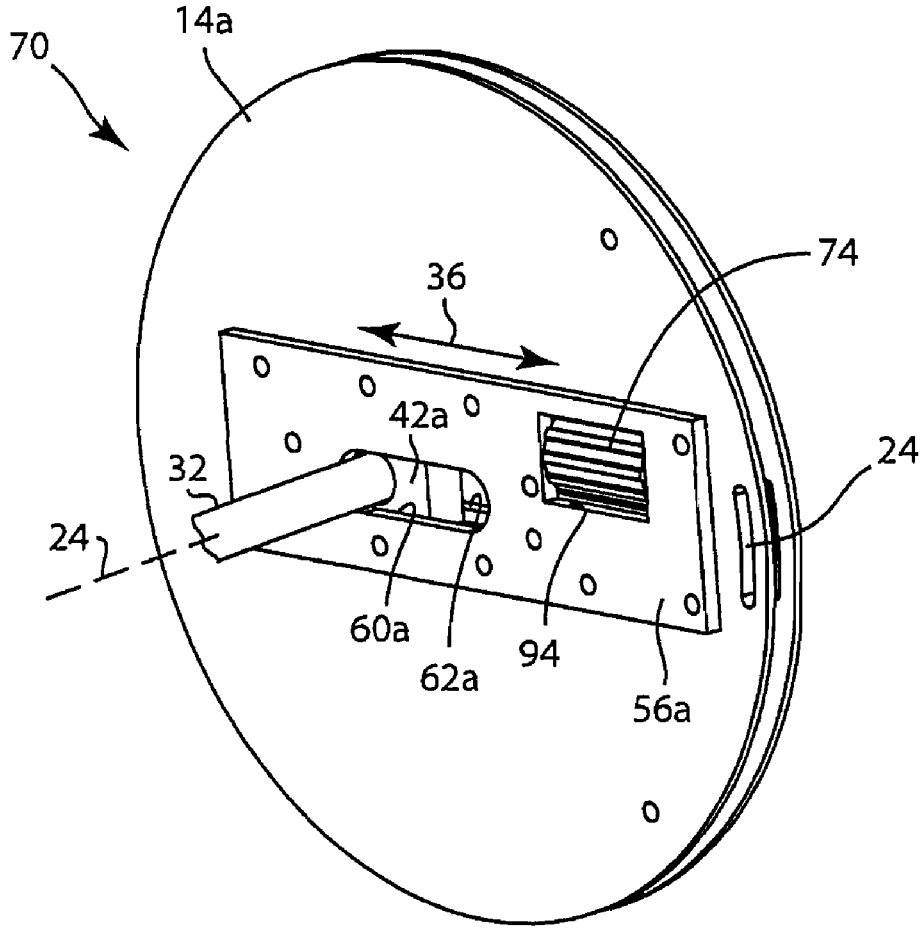
FIG. 3 is like FIG. 1 and shows another embodiment.
Figure 4:
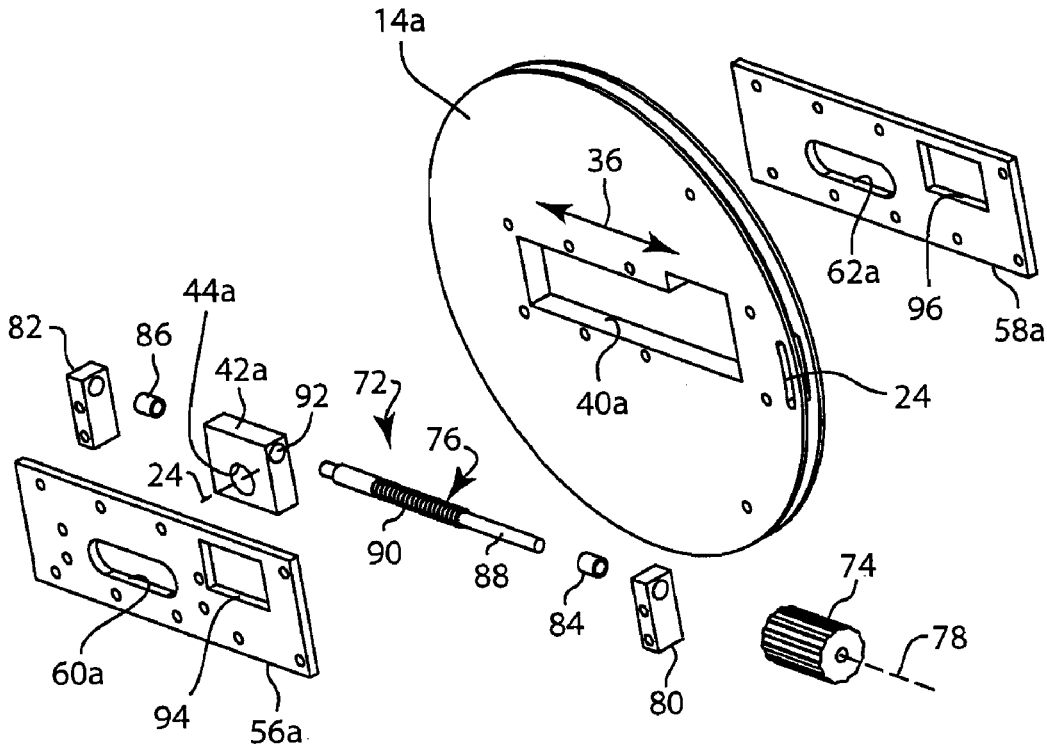
FIG. 4 is an exploded perspective view of the construction of FIG. 3.

FIGS. 3 and 4 show another embodiment and use like reference numerals from above where appropriate to facilitate understanding. Exercise apparatus 70 includes pulley 14*a* having an adjustable camming profile for changing the load curve, as above. Pulley 14*a* is eccentrically mounted on shaft 32 for rotation about rotation axis 24. An adjustment mechanism 72 adjustably translates pulley 14*a* across shaft 32 in the noted transverse direction 36 to different translational positions to change the noted load curve by changing the noted camming profile by changing the noted eccentricity. The adjustment mechanism is provided by slot 40*a* receiving shaft 32 extending axially therethrough. As above, pulley slot 40*a* has an extended dimension along transverse direction 36 receiving shaft 32 at a plurality of translational positions therealong. The adjustment mechanism further includes a slide block 42*a* having a shaft-mount portion 44*a* provided by an aperture extending axially therethrough and mounted to shaft 32. The adjustment mechanism further includes an adjuster member 74 cooperating via lead screw 76 between the pulley and slide block 42*a*. In the embodiment shown, adjuster member 74 is a wheel rotationally movable, i.e. is rotational about axis 78, to translate pulley

14*a* along transverse direction 36 to different translational positions of pulley slot 40*a* along shaft 32 and of pulley 14*a* along slide block 42*a*. Pulley 14*a* rotates with slide block 42*a* in each of the noted different translational positions. Axis 78 is parallel to transverse direction 36. Rotary wheel member 74 is rotationally mounted to the pulley and rotationally coupled to slide block 42*a* by screw coupling 76 rotational about axis 78 to translate pulley 14*a* along transverse direction 36 relative to slide block 42*a*.

First and second axially spaced plates 56*a* and 58*a*, FIG. 4, are mounted, e.g. by rivets, bolts, pins, welding, etc., to pulley 14*a* on axially distally opposite sides thereof at pulley slot 40*a*. The plates have respective slots 60*a* and 62*a* receiving shaft 32 extending axially therethrough. Pulley slot 40*a* is axially between first plate slot 60*a* and second plate slot 62*a*. First plate slot 60*a* and pulley slot 40*a* and second plate slot 62*a* are axially aligned. End blocks 80 an 82 are axially mounted between the plates in slot 40*a* and journal screw shaft 76 therein at respective bushings 84 and 86. Rotary wheel 74 is nonrotatably mounted on shaft portion 88, e.g. by welding, pinning, or the like. Threaded portion 90 of the shaft threadingly engages slide block 42*a* at threaded bore 92. Upon rotation of rotary wheel 74 about axis 78, the worm gear lead screw type engagement of shaft 76 at threaded portion 90 in threaded bore 92 of slide block 42*a* effects translational movement of pulley 14*a* along transverse direction 36 relative to shaft 32. Plates 56*a* and 58*a* have respective windows or apertures 94 and 96 providing user access to wheel 74 to enable user engagement and adjustment thereof. Alternatively, shaft 76 could be rotated by a small electric motor, e.g. a DC motor, which alternatively or additionally may be actuated by a software based user training program according to user commands.

It is recognized that various equivalents, alternatives and modifications are possible within the scope of the appended claims.

What is claimed is:

1. Exercise apparatus for resistance training comprising a cable trained around a pulley and coupled to a resistance for resisting a given user motion, said pulley having a camming profile providing a load curve in a plot of force versus displacement, such that resistive force opposing said user motion varies during such motion according to said displacement, said pulley having an adjustable camming profile for changing said load curve, wherein said pulley is eccentrically mounted on a shaft for rotation about a rotation axis, the eccentricity providing said camming profile, and comprising an adjustment mechanism comprising a first member mounted to said shaft, and a second member mounted to said pulley, said first and second members being movably coupled to each other to change said eccentricity according to movement of said second member relative to said first member, wherein said pulley is translational across said shaft in a direction transverse to said axis to change said eccentricity, said second member being translationally movable relative to said first member along said transverse direction, and wherein said pulley has a slot receiving said shaft extending axially therethrough, said pulley slot having an extended dimension along said transverse direction receiving said shaft at a plurality of translational positions therealong.

2. The exercise apparatus according to claim 1 wherein said first member comprises a slide block slidable along said pulley slot and having a shaft-mount portion mounted to said shaft, and said second member is adjustably coupled to said slide block to slide said pulley therealong in said transverse direction along said pulley slot to different translational positions to change said load curve.

3. The exercise apparatus according to claim 2 wherein said second member comprises first and second axially spaced plates mounted to said pulley on axially distally opposite sides thereof at said pulley slot, and wherein:

said first plate has a slot receiving said shaft extending axially therethrough;

said second plate has a slot receiving said shaft extending axially therethrough;

said pulley slot is axially between said first plate slot and said second plate slot;

said first plate slot and said pulley slot and said second plate slot are axially aligned.

4. The exercise apparatus according to claim 3 wherein said second member comprises a user-engagable retainer member mounted to at lease one of said plates and movable to engage and disengage said slide block.

5. The exercise apparatus according to claim 4 wherein said user-engagable retainer member is movable axially along a direction parallel to said rotation axis of said shaft to engage and disengage said slide block.

6. The exercise apparatus according to claim 3 wherein said second member comprises a rotary member rotationally mounted to at least one of said plates and rotationally coupled to said slide block to translationally slide said pulley along said slide block upon rotation of said rotary member.

7. The exercise apparatus according to claim 6 wherein said rotary member is rotational about an axis parallel to said transverse direction.

8. Exercise apparatus for resistance training comprising a cable trained around a pulley and coupled to a resistance for resisting a given user motion, said pulley having a camming profile providing a load curve in a plot of force versus displacement, such that resistive force opposing said user motion varies during such motion according to said displacement, said pulley having an adjustable camming profile for changing said load curve, wherein said pulley is eccentrically mounted on a shaft for rotation about a rotation axis, the eccentricity providing said camming profile. and wherein said pulley is translational across said shaft in a direction transverse to said axis to change said eccentricity, and comprising a user-engageable locking mechanism having a first locking position locking said pulley in a given translational position, and having a second release position permitting translational movement of said pulley in said transverse direction to a different translational position to change said load curve, and wherein said pulley has a slot receiving said shaft extending axially therethrough, said pulley slot having an extended dimension along said transverse direction and receiving said shaft at a plurality of said translational positions therealong.

9. The exercise apparatus according to claim 8 wherein said user-engageable locking mechanism comprises a slide block having a shaft-mount portion mounted to said shaft and extending transversely therefrom to a pulley-lock portion, and a user-engageable retainer member cooperating between said pulley and said pulley-lock portion of said slide block, said retainer member being moveable to a first locking position locking said pulley to said slide block to rotate therewith about said shaft, said retainer member being moveable to said second release position releasing said pulley from said slide block and permitting translational movement of said pulley along said transverse direction to a different translational position of said pulley slot along said shaft and of said pulley along said slide block.

10. The exercise apparatus according to claim 9 comprising first and second axially spaced plates mounted to said pulley on axially distally opposite sides thereof at said pulley slot, and wherein:

said first plate has a slot receiving said shaft extending axially therethrough;

said second plate has a slot receiving said shaft extending axially therethrough;

said pulley slot is axially between said first plate slot and said second plate slot;

said first plate slot and said pulley slot and said second plate slot are axially aligned.

11. The exercise apparatus according to claim 10 wherein said user-engageable retainer member comprises a locking pin on said first plate and moveable in a first axial direction toward said second plate to engage said slide block in said first locking position, and moveable in a second opposite axial direction away from said second plate to disengage said slide block in said second release position.

12. Exercise apparatus for resistance training comprising a cable trained around a pulley and coupled to a resistance for resisting a given user motion, said pulley having a camming profile providing a load curve in a plot of force versus displacement, such that resistive force opposing said user motion varies during such motion according to said displacement, said pulley having an adjustable camming profile for changing said load curve, wherein said pulley is eccentrically mounted on a shaft for rotation about a rotation axis, the eccentricity providing said camming profile, and wherein said pulley is translational across said shaft in a direction transverse to said axis to change said eccentricity, and comprising an adjustment mechanism adjustably translating said pulley across said shaft in said transverse direction to different translational positions to change said load curve, and wherein said adjustment mechanism comprises a rotary member mounted to said pulley and rotational about an axis parallel to said transverse direction to translate said pulley to said different translational positions.

13. The exercise apparatus according to claim 12 wherein said pulley has a slot receiving said shaft extending axially therethrough, said pulley slot having an extended dimension along said transverse direction and receiving said shaft at a plurality of said translational positions therealong.

14. The exercise apparatus according to claim 13 wherein said adjustment mechanism comprises a slide block having a shaft-mount portion mounted to said shaft, and an adjuster member cooperating between said pulley and said slide block, said adjuster member being movable to translate said pulley along said transverse direction to different translational positions of said pulley slot along said shaft and of said pulley along said slide block, said pulley rotating with said slide block about said shaft in each of said different translational positions.

15. The exercise apparatus according to claim 14 wherein said adjuster member comprises a rotary member rotationally mounted to said pulley and rotationally coupled to said slide block by a screw coupling rotational about an axis parallel to said transverse direction to translate said pulley along said transverse direction relative to said slide block.

16. The exercise apparatus according to claim 14 wherein said adjuster member comprises first and second axially spaced plates mounted to said pulley on axially distally opposite sides thereof at said pulley slot, and wherein:

said first plate has a slot receiving said shaft extending axially therethrough;

said second plate has a slot receiving said shaft extending axially therethrough;

said pulley slot is axially between said first plate slot and said second plate slot;

said first plate slot and said pulley slot and said second plate slot are axially aligned.

17. The exercise apparatus according to claim 16 wherein said adjuster member comprises a rotary member rotationally mounted to at least one of said plates and rotationally coupled to said slide block to translationally slide said pulley along said slide block upon rotation of said rotary member.

18. Exercise apparatus for resistance training comprising a cable trained around a pulley and coupled to a resistance for resisting a given user motion, said pulley being eccentrically mounted on a shaft for rotation about a rotation axis, said pulley being translational across said shaft in a direction transverse to said axis to change said eccentricity, an adjustment mechanism adjustably changing the translational position of said pulley alone said shaft in said transverse direction, wherein said adjustment mechanism comprises a user-engageable locking mechanism having a first locking position locking said pulley in a given translational position, and having a second release position permitting translational movement of said pulley in said transverse direction to a different translational position on said shaft and wherein said pulley has a slot receiving said shaft extending axially therethrough, said pulley slot having an extended dimension along said transverse direction receiving said shaft at a plurality of said translational positions therealong, and said user-engageable locking mechanism comprises a slide block having a shaft-mount portion mounted to said shaft and extending transversely therefrom to a pulley-lock portion, and a user-engageable retainer member cooperating between said pulley and said pulley-lock portion of said slide block, said retainer member being moveable to said first locking position locking said pulley to said slide block to rotate therewith about said shaft, said retainer member being moveable to said second release position releasing said pulley from said slide block and permitting translational movement of said pulley along said transverse direction to a different translational position of said pulley slot along said shaft and of said pulley along said slide block.

19. Exercise apparatus for resistance training comprising a cable trained around a pulley and coupled to a resistance for resisting a given user motion, said pulley being eccentrically mounted on a shaft for rotation about a rotation axis, said pulley being translational across said shaft in a direction transverse to said axis to change said eccentricity, an adjustment mechanism adjustably changing the translational position of said pulley along said shaft in said transverse direction, wherein said adjustment mechanism comprises a translational member adjustably translating said pulley across said shaft in said transverse direction to different translational positions to change said load curve, and wherein said pulley has a slot receiving said shaft extending axially therethrough, said pulley slot having an extended dimension along said transverse direction and receiving said shaft at a plurality of said translational positions therealong, and said adjustment mechanism comprises a slide block having a shaft-mount portion mounted to said shaft, and an adjuster member cooperating between said pulley and said slide block, said adjuster member being movable to translate said pulley along said transverse direction to different translational positions of said pulley slot along said shaft and of said pulley along said slide block, said pulley rotating with said slide block about said shaft in each of said different translational positions.

* * * * *